US005381937A

United States Patent [19]

Thompson et al.

[11] Patent Number: 5,381,937

[45] Date of Patent: Jan. 17, 1995

[54] POCKET-FOLDING DEVICE

[76] Inventors: Kenneth J. Thompson, Rte. 3, Box 2575, Lexington, N.C. 27292; John R. Everhart, 5012 Meadow Hill Ct., Winston-Salem, N.C. 27106; Joel C. Rosenquist, 9430 Morton Dr., Kernersville, N.C. 27284; Wayne G. Foster, 3184 Turkey Hill Rd., Winston-Salem, N.C. 27106

[21] Appl. No.: 177,238

[22] Filed: Jan. 4, 1994

Related U.S. Application Data

[63] Continuation-in-part of Ser. No. 959,081, Oct. 9, 1992, abandoned.

[51] Int. Cl.[6] ..... A41H 33/00; D06C 15/00

[52] U.S. Cl. ..... 223/37; 223/38; 223/52.6; 223/57

[58] Field of Search ..... 223/37, 38, 52.6, 52.5, 223/52.3, 57; 112/147

[56] References Cited

U.S. PATENT DOCUMENTS

| | | | |
|---|---|---|---|
| 2,122,303 | 6/1938 | Tolen et al. | 223/38 |
| 2,858,967 | 11/1958 | Gilbert | 223/38 |
| 2,880,916 | 4/1959 | Nassef | 223/38 |
| 2,929,537 | 3/1960 | Price et al. | 223/38 |
| 3,419,200 | 12/1968 | Aramini | 223/38 |
| 3,478,939 | 11/1969 | Denault et al. | 223/38 |
| 3,945,541 | 3/1976 | Levine et al. | 223/38 |
| 5,074,230 | 12/1991 | Marii et al. | 223/38 |

FOREIGN PATENT DOCUMENTS

| | | | |
|---|---|---|---|
| 18797 | 2/1957 | Japan | 223/38 |
| 268870 | 11/1987 | Japan | 223/38 |
| 613752 | 7/1978 | U.S.S.R. | 223/38 |
| 955896 | 9/1982 | U.S.S.R. | 223/52.6 |
| 1117042 | 10/1984 | U.S.S.R. | 223/37 |

*Primary Examiner*—Clifford D. Crowder
*Assistant Examiner*—Bibhu Mohanty

[57] ABSTRACT

A pocket-folding device for folding a pocket blank and securing the folded pocket to a pocket-carrying article, the device having a locating fixture supported by a frame to receive the unfolded pocket blank, a top die and movable bottom die supported by the frame, and a vacuum hand associated with the frame selectively moving to pick up the unfolded pocket blank from the locating fixture and carry it and release it over the pocket form to form side and bottom-draped edges. The pocket form and pocket blank move up to mate with the top die. The bottom die then moves up to mate with the top die to form a die cavity around the pocket form and pocket blank while selectively directed air flows into the top die and folds the draped pocket edges around the pocket form. Heat is applied to the folded pocket edges to set pocket edge creases therein, and the pocket form, pocket and bottom die move downwardly to the original bottom die position with the pocket-folded edges held between the pocket form and the bottom die. The pocket form is moved away from the pocket and bottom die. The vacuum hand moves to secure the folded edge pocket and position it at a pre-selected location on a pocket-carrying article. Appropriately programmed sewing means may subsequently sew the folded pocket to the article.

12 Claims, 8 Drawing Sheets

POCKET-FOLDING DEVICE

This application is a continuation-in-part application of my earlier application Ser. No. 07/959,081 filed Oct. 9, 1992 now abandoned.

BACKGROUND OF THE INVENTION

1. Field of the Invention

The present invention relates to pocket-folding devices and more particularly to a new and improved pocket-folding device for automatically folding a pocket blank and positioning the folded pocket at a predetermined location.

2. Description of the Prior Art

Various types of pocket-folding devices are known in the prior art which are used to prepare pockets for attachment to pocket-carrying articles. For the most part, these prior art devices involve folding the pocket edges mechanically with cams or other elements that provides substantially a straight fold but which fold subsequently becomes slightly misaligned and requires adjustment by hand. While the operation of these devices adequately accomplishes the intended objective, the operation is rather slow because of the need to make manual adjustments to the folds in the pocket after the machine has cycled.

Other folding devices involve linear metallic or plastic strips configured to cause moving fabric to turn on itself prior to introduction to a sewing mechanism. These successfully operate to sew fabric edges, unfortunately a manual operation is usually required thereafter to apply and sew the article to another surface.

Thus there has been a need for a more rapid and reliable device to eliminate the manual movement and adjustment of a folded pocket to be sewn to a pocket-carrying article that is associated with prior art devices. The present invention has been designed and configured to address this need.

SUMMARY OF THE INVENTION

The general purpose of the present invention which will be described subsequently in greater detail is to provide a new and improved pocket-folding and attaching device for securing a folded pocket to a pocket-carrying article which has all of the advantages of prior art devices and none of the disadvantages. To attain this purpose, a representative embodiment of the present invention is illustrated in the drawings and makes use of a locating fixture, top and bottom dies, a pocket form and a vacuum hand, all associated with a supporting frame. The vacuum hand picks the unfolded pocket from a locating fixture, moves it between the top and bottom dies and over the pocket form so that the unsewn pocket lying over the pocket form has side and bottom-draping edges. The vacuum hand moves away and the top and bottom dies are formed around the pocket and pocket form. An air supply is selectively directed into the top die as the die components come together and fold the pocket edges around the pocket form. Heat is then applied to set pocket edge creases in the folded pocket. The pocket form, pocket, and bottom die move downwardly to the original position, the pocket form is moved away from the pocket and bottom die, and the vacuum hand picks the folded pocket and positions it at a pre-selected location on the pocket carrying article.

Thus there has been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. It is also to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the invention. It is important that the claims be regarded as including such equivalent constructions insofar as they do not depart from the spirit and scope of the present inventive concept. The abstract included herewith is neither intended to define the invention of the application, which is measured by the claims, nor limit the scope of the invention in any way.

It is therefore an object of the present invention to provide a new and improved pocket-folding and attaching device for securing a folded pocket to a pocket-carrying article which has all of the advantages of prior art folding and attaching devices and none of the disadvantages.

It is another object of the present invention to provide a new and improved pocket-folding and attaching device that can complete the folding and securing of a pocket to a pocket-carrying article without manual adjustments.

It is a further object of the present invention to provide a device of the type described which utilizes selectively distributed airflow to fold the pocket edges against the pocket form for subsequent creasing.

It is yet still another object of the present invention to provide a device of the type described which removes the pocket form from the pocket after folding and creasing has taken place without any misalignment of the folded and creased edges.

It is yet still another further object of the present invention to provide a new and improved device of the type described which can secure and position the folded-edge pocket at the desired location on the pocket-carrying article and in direct contact with an appropriate sewing means.

It is yet still another further object of the present invention to provide a new and improved device of the type described which will utilize a programmed sewing device to sew continuously along extended edges and sense changes of sewing direction to enable repositioning of the edge to be sewn.

These together with other objects of the invention, along with the various features of novelty which characterize the invention, are pointed out with particularity in the claims annexed to and forming a part of this disclosure. For a better understanding of the invention, its operating advantages and the specific objects obtained by its uses, reference should be made to the accompanying drawings and descriptive matter in which like characters of reference designate like parts throughout the several views.

BRIEF DESCRIPTION OF THE DRAWINGS

The invention will be better understood and objects other than those set forth above will become apparent when consideration is given to the detailed description that follows. Such description makes reference to the annexed drawings wherein.

DESCRIPTION OF THE PREFERRED EMBODIMENT

Figure 1:
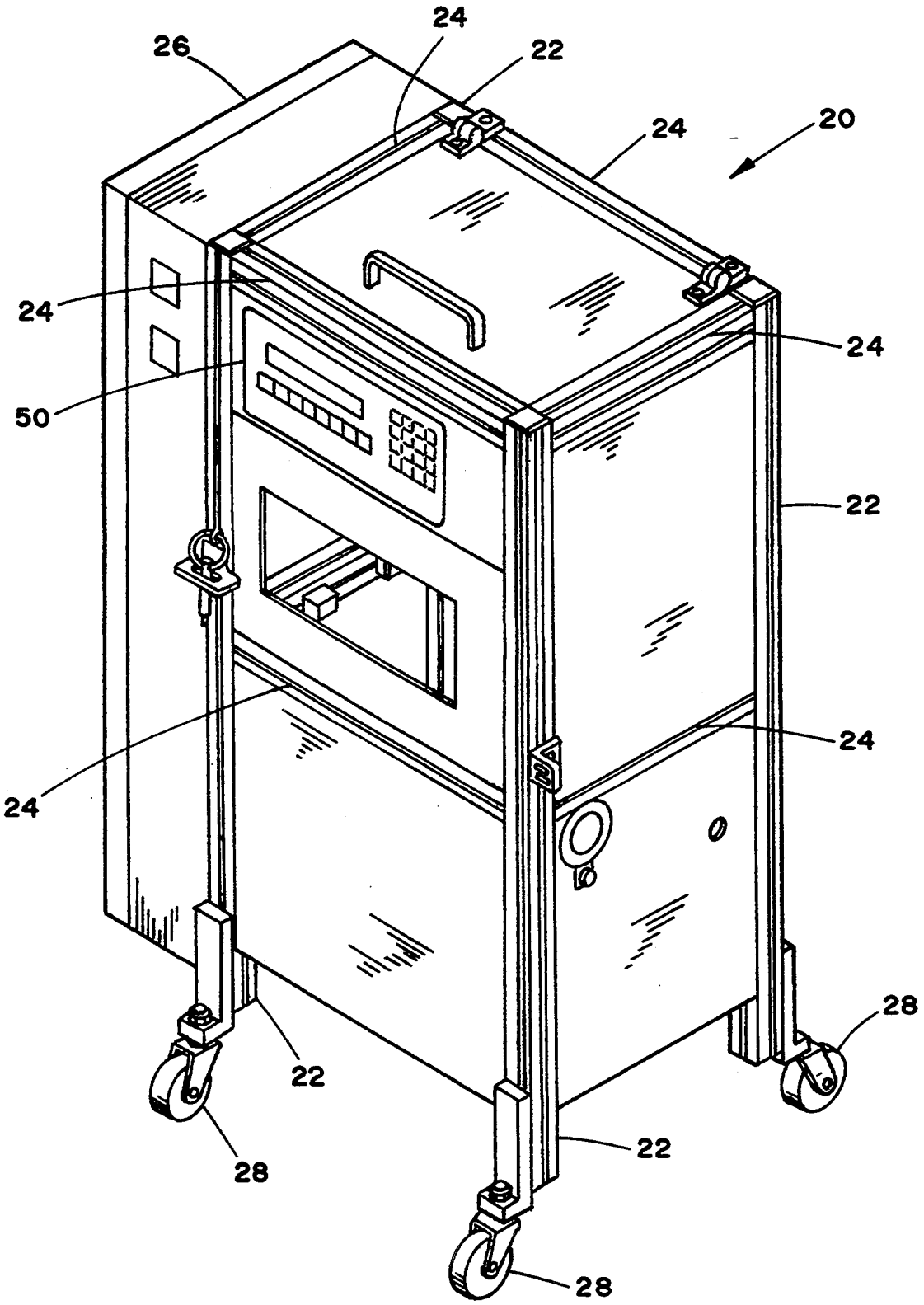
FIG. 1 is a perspective view of the exterior of the pocket-folding and attaching device comprising the present invention.
Figure 2:
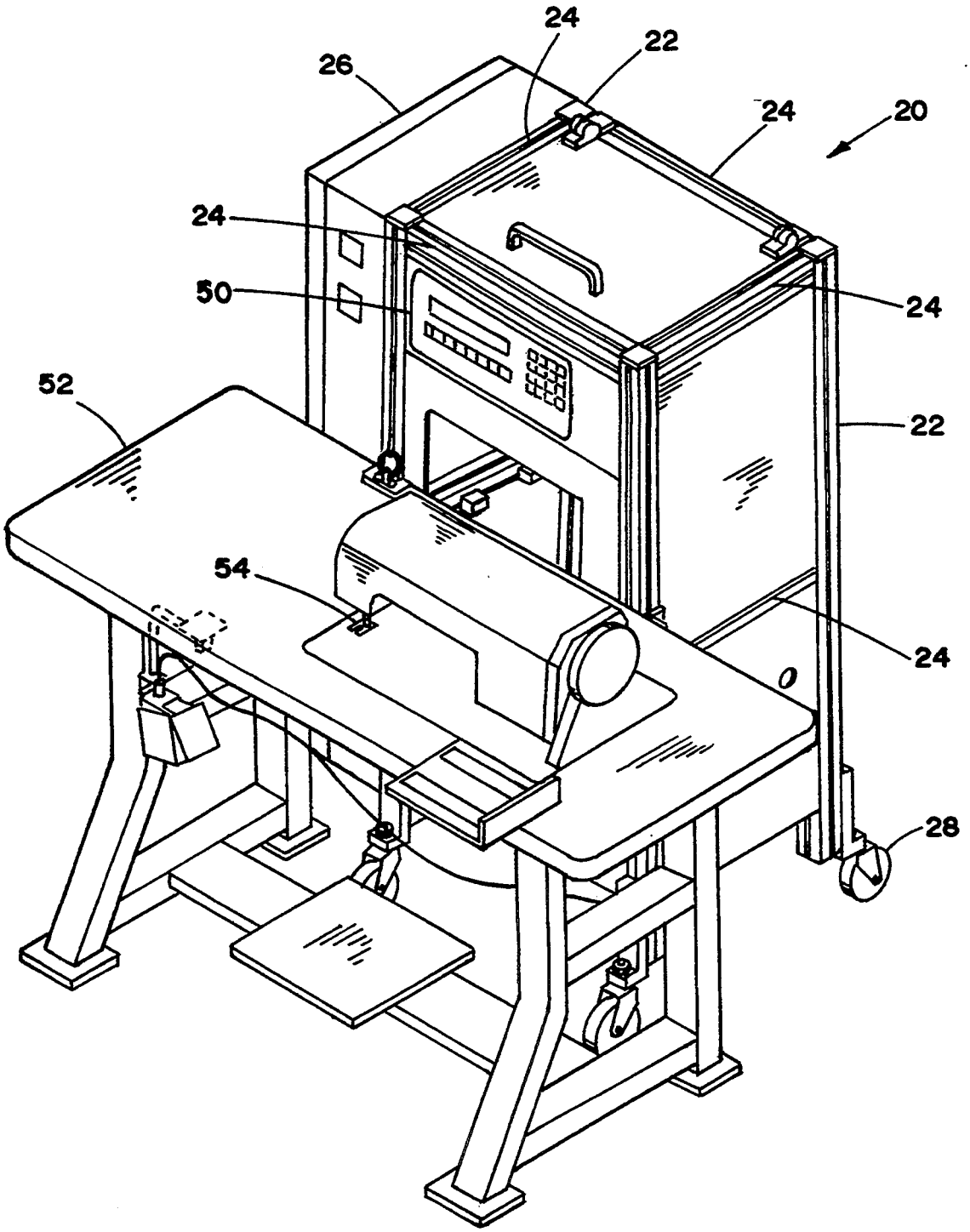
FIG. 2 is a perspective view of the pocket-folding and attaching device of FIG. 1 associated with a cooperating and program sewing device for securing a pocket appropriately folded by the folding device to a pocket-carrying article.

With reference now to the drawings and particularly to FIG. 1, the pocket-folding device of the present invention shown generally as 20 includes a frame having supporting legs 22 and horizontal connecting members 24 which cooperate to provide an interior suitable for supporting the various cooperating components subsequently to be described. A housing 26 serves to hold the various electrical and mechanical devices necessary to operate the components in the manner to be described. A plurality of wheels 28 provide the device mobility so that it can be positioned with respect to associated and cooperating equipment in a rapid and efficient manner.

Figure 3:
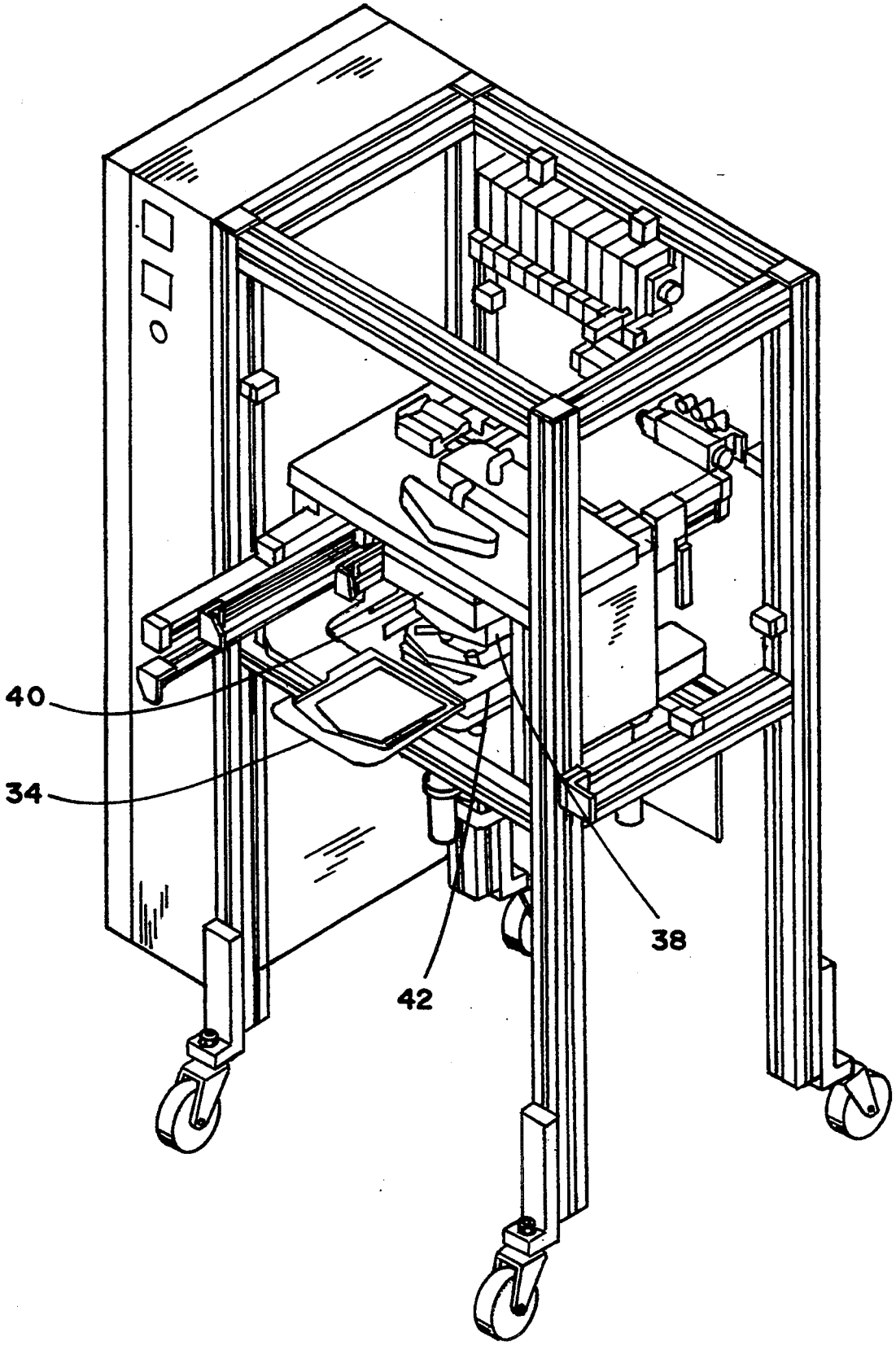
FIG. 3 is a perspective and partial view of the device of FIG. 1 showing the assembly of the locating fixture, the top and bottom die, and the vacuum hand, all movable within the frame.
Figure 4:
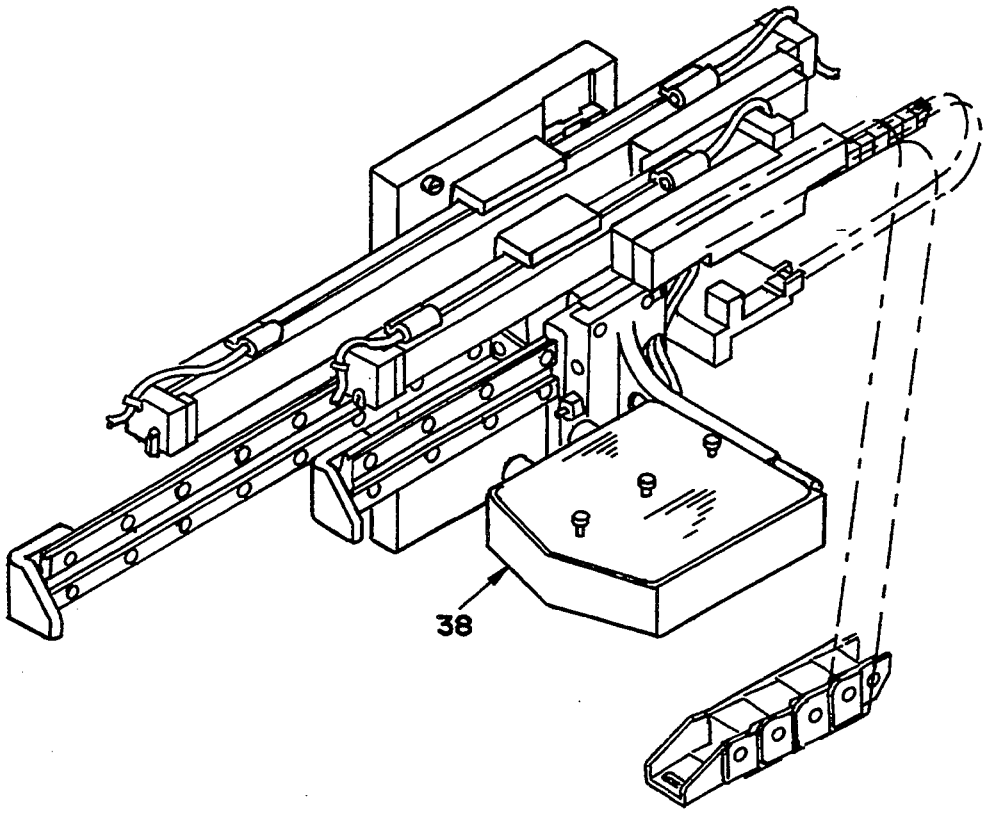
FIG. 4 is a perspective, isolated and enlarged view of the vacuum hand forming a part of the present invention.
Figure 5:
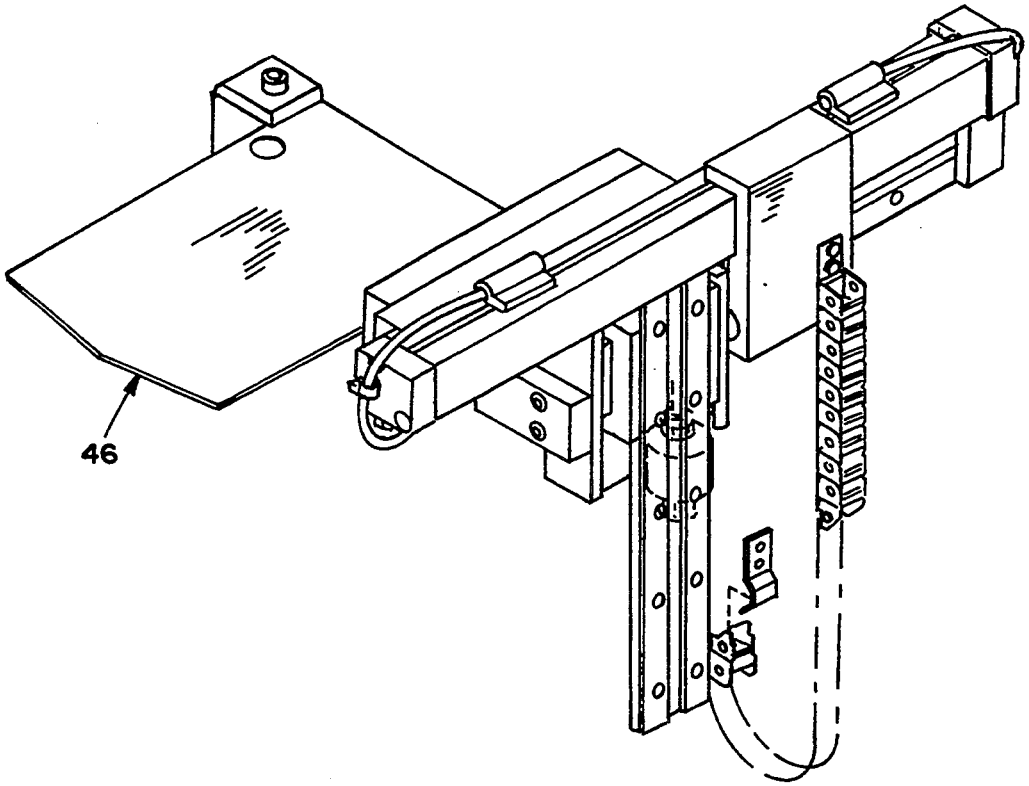
FIG. 5 is a perspective, isolated and enlarged view of the pocket form and its related components.
Figure 6:
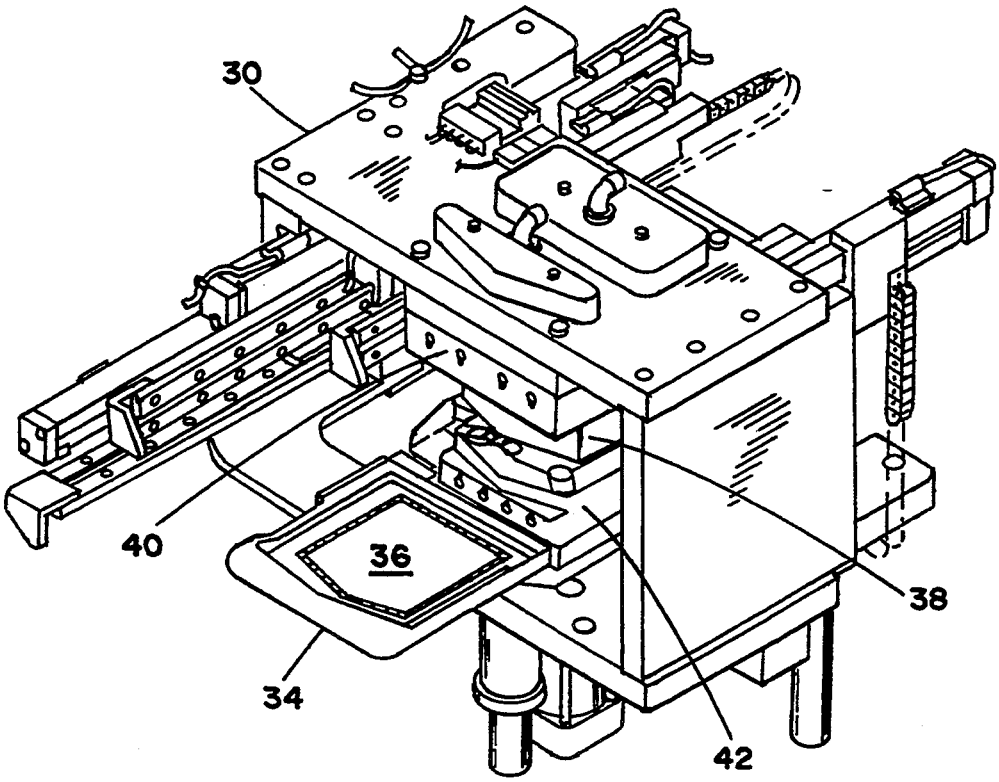
FIG. 6 is a perspective, isolated and enlarged view of the locating fixture, bottom and top dies, and vacuum hand which was shown positioned within the frame in FIG. 3.
Figure 7:
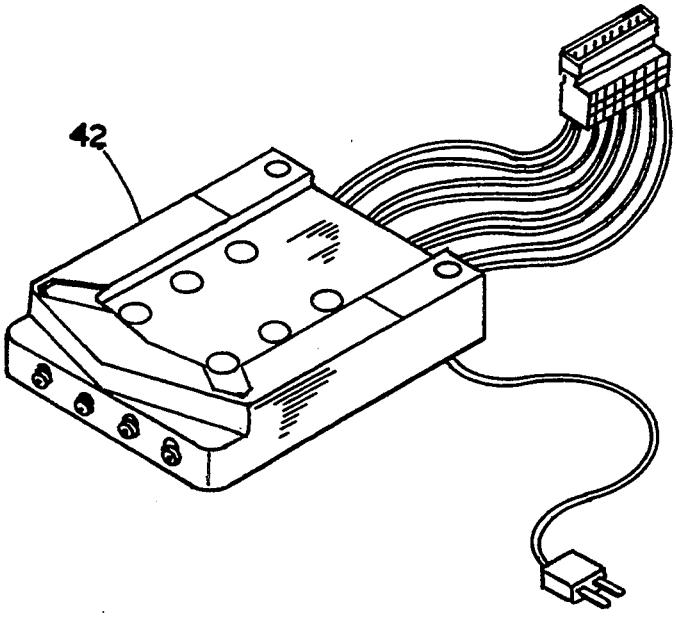
FIG. 7 is a perspective, isolated and enlarged view of the bottom die.
Figure 8:
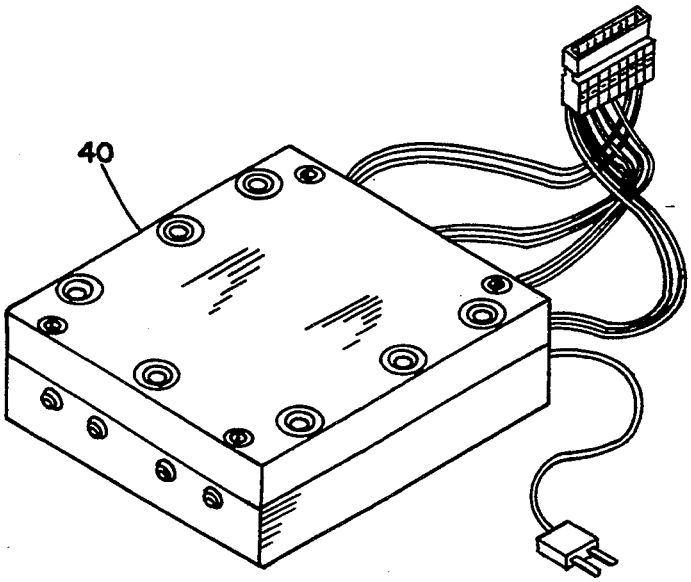
FIG. 8 is a perspective, enlarged, and isolated view of the top die and its related components.
Figure 9:
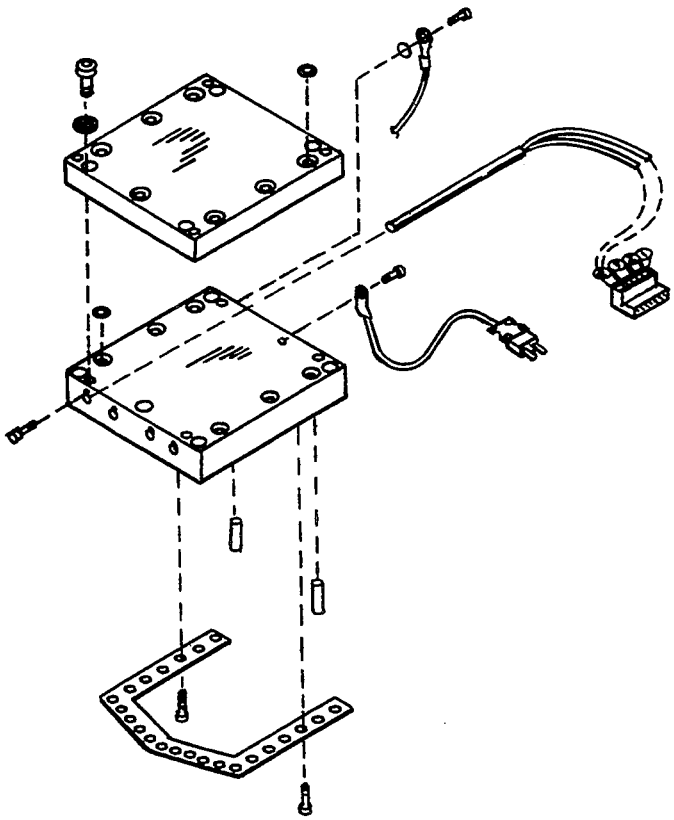
FIG. 9 is an exploded view of the top die and related components shown in FIG. 8.
Figure 10:
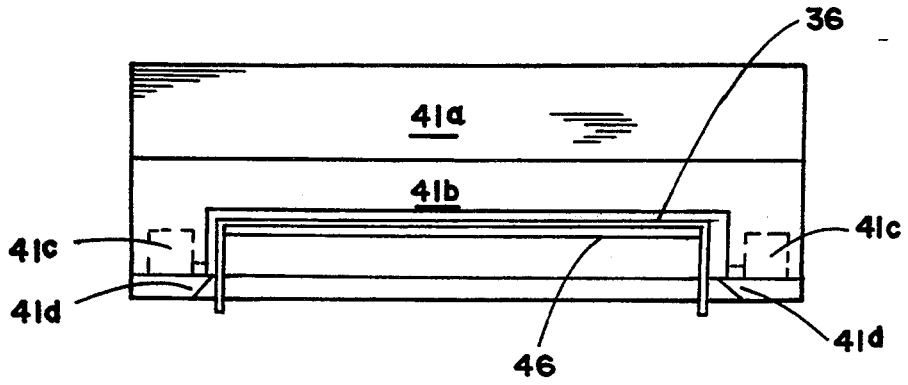
FIG. 10 is an end elevational, enlarged and isolated view of the top die and its related components showing the cavity holding the pocket form over which is draped a pocket and their association with the air chamber.

The main assembly shown generally as 30 (FIG. 6) is held substantially horizontally within the interior of the frame as shown in FIG. 3 so that operational movement of the components included within assembly 30 are vertical and horizontal, the horizontal operation being into and out from the frame housing. A locating fixture 34 is shown in FIGS. 3 and 6 in the inward position and carries an unfolded pocket 36 awaiting pick-up by vacuum hand 38 also shown in FIGS. 3 and 6 in its innermost position. A top die 40 is carried in the top of assembly 30 in the manner best shown in FIG. 3 where it awaits the formation of a die space when coupled with bottom die 42. This occurs when vacuum hand 38 moves out from the interior of assembly 30 and over to engage pocket blank 36 by its associated vacuum. Vacuum hand 38 then moves inwardly to the position shown in FIG. 6 and deposits pocket blank 36 over pocket form 46 so that the pocket side and bottom edges drape over pocket form 46 as it moves upwardly into the partial cavity of top die 40. Once vacuum hand 38 has lowered pocket blank 36 to pocket form 46, its vacuum is terminated and it moves forward from the die space to a waiting position. Pocket form 46 with the carried pocket blank 36 moves into the cavity 39 of top die 40.

Figure 11:
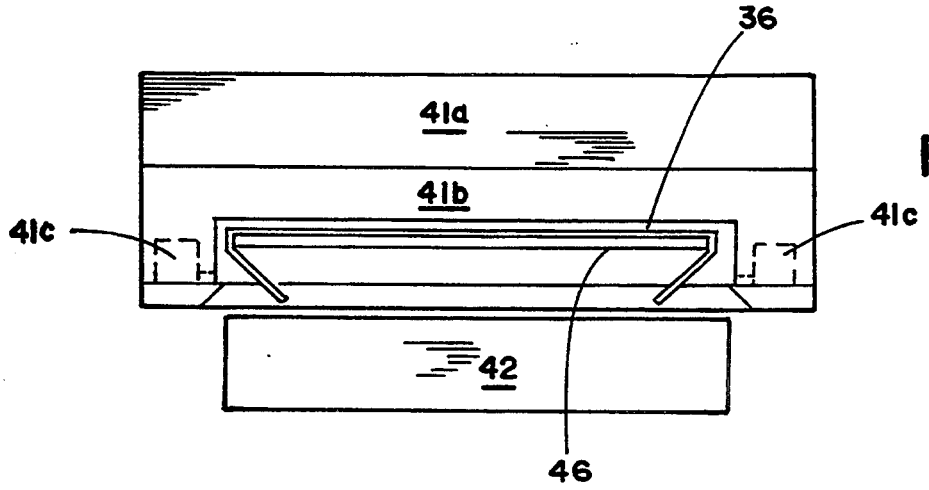
FIG. 11 is a view of the top die shown in FIG. 10 illustrating the air flow directed against the draped edges of the pocket and the movement of the bottom die upwardly to close the cavity.
Figure 12:
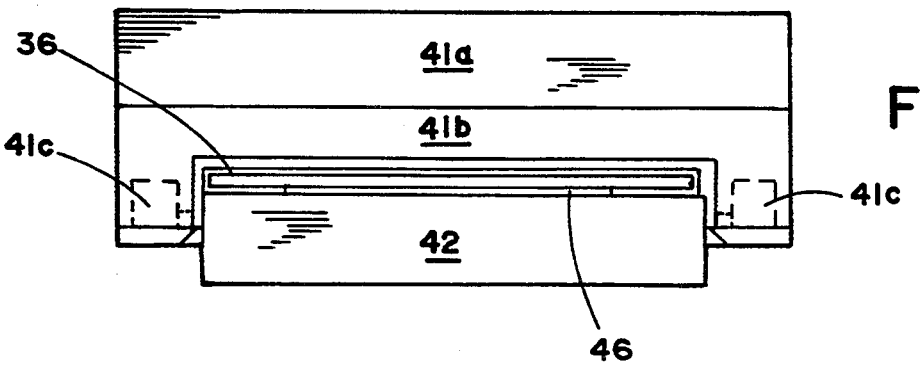
FIG. 12 is another view of the top die shown in FIGS. 10 and 11 wherein the bottom die has closed against the top die to encapsulate the folded pocket around the pocket form within the cavity.
Figure 13A:
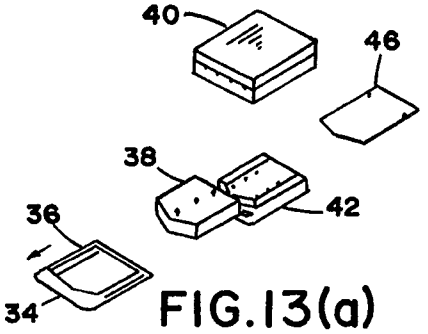
FIG. 13(*a*)–(*j*) are isometric views of the top and bottom dies, the pocket form, the pocket, and the vacuum hand as the device comprising the present invention sequences through its operating cycle.
Figure 13B:
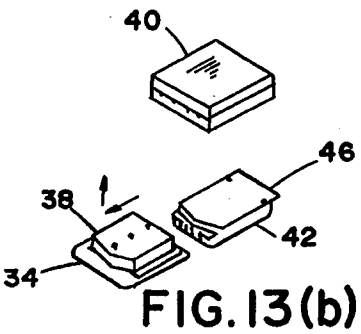
Figure 13C:
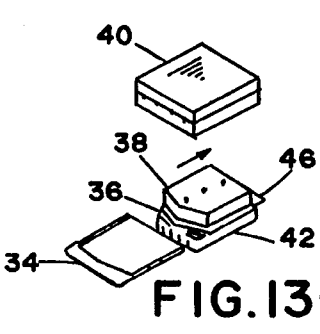
Figure 13D:
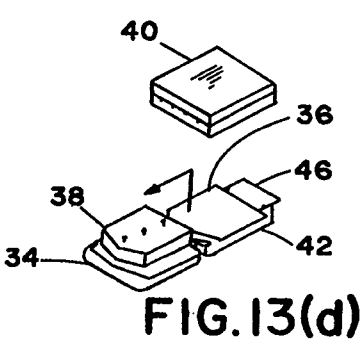
Figure 13E:
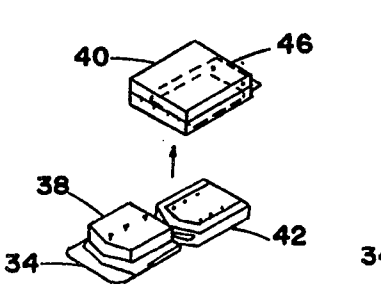
Figure 13F:
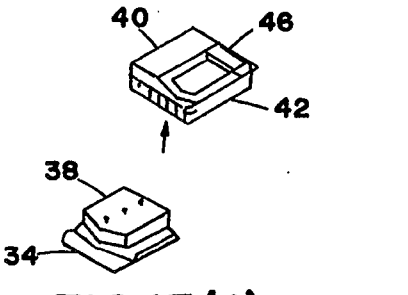
Figure 13G:
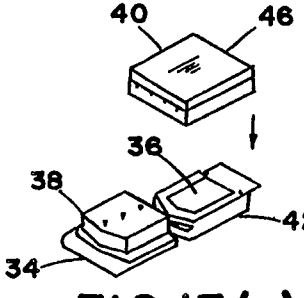
Figure 13H:
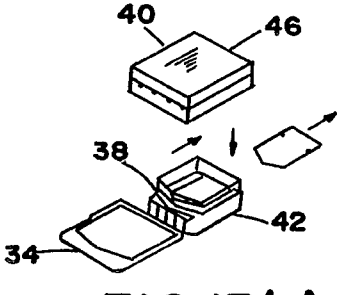
Figure 13I:
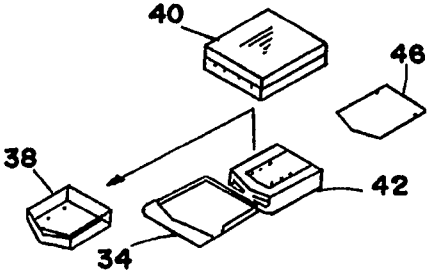
Figure 13J:
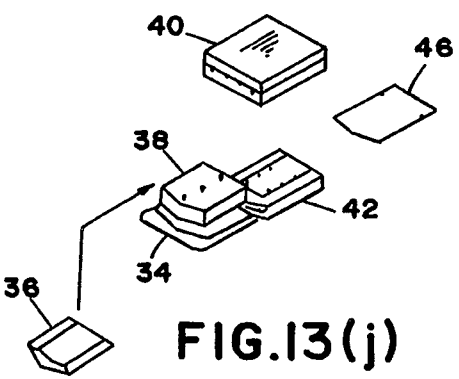

The top die is made up of a top insulator 41*a*, a die body portion 41*b*, an air chamber 41*c*, and openings 41*d* through which air may flow from air chamber 41*c*. Airflow (see arrows in FIG. 11) engages the draped pocket edges in the manner shown.

Bottom die 42 then moves upwardly to encapsulate pocket blank 36 and pocket form 46 as bottom edge folding air is activated from top die 40. The air extends along the draping edges of pocket 36 to fold those edges 90 degrees up under pocket form 46. After folding takes place, the folded edges are caught by the positioning of bottom die 42 and the folding air is terminated.

Heat is applied to the folded pocket edges during a creasing cycle after which pocket form 46 and pocket 36 move down simultaneously. The edges of pocket 36 are held between pocket form 46 and bottom die 42.

Vacuum hand 38 then moves back into the die space and lowers to sandwich pocket form 46 and pocket 36 between bottom die 42 and vacuum hand 38. Pocket form 46 is then removed rearwardly, a vacuum is applied to vacuum hand 38, and vacuum hand 38 moves to an upward position with pocket 36 and then out of the die space to a waiting position which can be over the article to which the folded pocket is to be attached. The vacuum is terminated, and the folded pocket is deposited in the precise location needed for the subsequent operation that occurs.

The folding and creasing cycle will now be summarized with reference to FIG. 13(*a*)–(*j*). In FIG. 13(*a*), the locating fixture 34 extends to receive pocket blank 36. Locating fixture 34 then retracts, and pocket form 46 moves forward over bottom die 42 as vacuum hand 38 picks up pocket blank 36 from locating fixture 34 (FIG. 13(*b*)). Vacuum hand 38 then deposits pocket blank 36 onto pocket form 46 (FIG. 13(*c*)). Vacuum hand 38 goes up and forward to an out-of-the-way location (FIG. 13(*d*)). Pocket form 46 then extends up into the cavity of top die 40 with edges of the pocket blank 36 draped over pocket form 46 (FIG. 13(*e*)). Bottom die 42 begins upward travel as selectively directed air flow begins in top die 40 thereby folding the draped pocket edges around pocket form 46 as it meets top die 40. Heat is applied at this point to set creases in pocket blank 36 (FIG. 13(*f*)). Pocket form 46 and bottom die then descend from top die 40 (FIG. 13(*g*)). Vacuum hand 38 retracts over the newly creased pocket 36 on pocket form 46 and is positioned on the pocket. Pocket form 46 then retracts to its beginning position (FIG. 13(*h*)). Vacuum hand 38 then picks up creased pocket 36 and extends out over the sewing area where it deposits pocket 36 onto the pocket carrying article (FIG. 13(*i*)). Vacuum hand 38 moves up and into home position. The locating fixture 34 moves to the loading position to begin a new cycle (FIG. 13(*j*)).

Details of pocket form 46 and its associated mechanism, top die 40, bottom die 42, and vacuum hand 38 are shown in FIGS. 5, 7, 8, and 4, respectively. Folding device 20 has a display panel 50 constantly reflecting information concerning production rate and machine efficiency, and providing trouble-shooting information in the event that one or more components of the machine should malfunction for whatever reason.

The most convenient use of the pocket-folding device described above is in association with a sewing machine shown generally as 52 wherein pocket folding can take place on device 20 and the folded pocket is then deposited against the surface of a garment, for example, a knit shirt, positioned under the presser foot and needle 54. The shirt is aligned by an operator of the machine so that by positioning its shoulder seams or collar in alignment with an indicating edge, the pocket will be deposited by the pocket-folding device 20 at the precise location needed. The operator can then operate the machine to sew the pocket in a semi-automated fashion wherein the machine will sew automatically along a straight edge until that edge terminates, at which time it will cease operation. The operator can then align the garment along a new straight edge so that the machine can sew continuously until that edge is completed, stopping again to allow the operator to reposition the garment and allow subsequent sewing steps until the pocket is completely attached to the garment.

The operator then removes the pocket-carrying garment to a supply, for example, on his or her right side where there is also located a supply of unfolded pockets. The operator selects a pocket, moves back toward the center of the work area and places it on locating fixture 34 which is extended outwardly beyond the position shown in FIGS. 3 and 6. Once the pocket has been thus positioned, it is moved inwardly to the position shown in FIGS. 3 and 6 where it is secured by vacuum hand 38 in the manner previously described.

From this detailed description it can be seen that a pocket-folding device which may be connectible to a cooperating attaching device, has been provided that will meet all of the advantages of the prior art and offer additional advantages not offered by the prior art. The device functions to allow the folding and attaching process to occur much more rapidly than heretofore has been the case. For example, an operator during a single 8-hour shift may produce as many as 125 dozen pocket-attached shirts while only about 30 dozen were attainable during an equal shift with conventional equipment.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification, are intended to be encompassed herein.

The foregoing is considered as illustrative only of the principles of the invention. Since numerous modifications and changes will readily occur under those skilled in the art, it is not desired to limit the invention to the exact construction and operation shown and described. All suitable modifications and equivalents that fall within the scope of the appended claims are deemed within the present inventive concept.

What is claimed as being new and desired to be protected by Letters Patent of the United States is as follows:

1. A pocket folder comprising: a frame; means carried by the frame to receive an unfolded pocket; die means associated with the frame having a top and a bottom; a pocket form supported by the frame movable into and out of engagement with the pocket and die means; a vacuum hand supported by the frame and movable to pick up the pocket, drape the pocket over the pocket form and move to a remote location as the draped pocket, pocket form and die means move together, the die means having an air supply directed against the draped edges to fold the edges against the pocket form; heating means to crease the folded edges, the vacuum hand moving from the remote location to secure the folded pocket as the pocket form is removed and move the folded pocket to a remote location.

2. The devices claimed in claim 1 further comprising: attaching means positioned at the remote location to receive the folded pocket and secure the folded pocket to an article.

3. The devices claimed in claim 2 wherein the article is a shirt.

4. A pocket-folding and attaching device for securing a folded pocket to a pocket-carrying article comprising: a frame; a locating fixture movably supported by the frame to receive an unfolded and unsewn pocket; a top die carried by the frame; a bottom movable die carried by the frame; a pocket form supported by the frame and movable into and out of engagement with the pocket and top and bottom dies; a vacuum hand associated with the frame selectively movable to pick up the unfolded and unsewn pocket from a locating fixture and carry the pocket to the pocket form, release the pocket over the pocket form, thereby forming side and bottom-draped edges, and move away from the pocket form, release the pocket over the pocket form, thereby forming side and bottom-draped edges, and move away from the pocket form and pocket as the bottom die, pocket form and pocket move to mate with the top die to form a die cavity around the pocket form and pocket; and an air supply means selectively directed into the top die folding the pocket edges around the pocket form; a source for applying heat to the folded pocket edges and setting pocket edge creases therein, the pocket form, pocket and bottom die movable downwardly to the original bottom die position with the pocket-folded edges held between the pocket form and the pocket die, the pocket form movable away from the pocket and bottom die and the vacuum hand movable to pick up the folded-edge pocket and position it at a pre-selected location on a pocket-carrying article.

5. The device as claimed in claim 4 further comprising sewing means for attaching the folded pocket to the article.

6. The device as claimed in claim 4 wherein the folded pocket is movable by the vacuum hand to a pre-selected intermediate position prior to movement to the pre-selected location on a pocket-carrying article.

7. The device as claimed in claim 5 wherein the folded pocket is movable by the vacuum hand to a pre-selected intermediate position prior to movement to the pre-selected location on the pocket-carrying article.

8. The device as claimed in claim 4 wherein the bottom die moves up to form the die cavity around the pocket form and pocket after the pocket form have moved upwardly adjacent to top die.

9. The device as claimed in claim 5 wherein the article is a shirt.

10. A method of folding and attaching a pocket to a pocket-carrying article comprising the steps of: positioning an unfolded pocket over a pocket form so that the pocket edges to be sewn are draped off the form; directing a flow of air against the draped pocket edges to cause the edges to fold around and against the pocket form; applying heat against the folded edges to form creases; removing the pocket form from the folded and creased edges; and moving the folded pocket to a remote location.

11. The method as claimed in claim 10 further comprising the steps of: positioning an article to receive the pocket at the remote location; and attaching the folded and creased pocket to the article.

12. The method as claimed in claim 11 wherein the folded and creased pocket is attached by sewing the pocket to the article.

* * * * *